United States Patent [19]

Lavanchy

[11] Patent Number: 4,741,500

[45] Date of Patent: May 3, 1988

[54] PROCESS FOR AUTOMATIC FEEDBACK CONTROLLED CABLE WINDING

[76] Inventor: Gérard A. Lavanchy, 12, avenue de la Rochelle, 1008 Prilly, Switzerland

[21] Appl. No.: 96,823

[22] Filed: Sep. 10, 1987

Related U.S. Application Data

[63] Continuation of Ser. No. 896,309, Aug. 12, 1986, abandoned, which is a continuation of Ser. No. 541,558, Oct. 13, 1983, abandoned.

[30] Foreign Application Priority Data

Oct. 28, 1982 [CH] Switzerland ..... 6282/82

[51] Int. Cl.[4] ..... B65H 54/28

[52] U.S. Cl. ..... 242/158 R

[58] Field of Search ..... 242/158 R, 158 B, 158 F, 242/158.1, 158.2, 158.4 R, 158.4 A, 25 R

[56] References Cited

U.S. PATENT DOCUMENTS

| | | | |
|---|---|---|---|
| 2,900,145 | 8/1959 | Hanson | 242/158.2 |
| 3,544,035 | 12/1970 | Woolever | 242/158 R |
| 3,822,831 | 7/1974 | Marcum, Jr. | 242/158 R X |
| 3,951,355 | 4/1976 | Morioka et al. | 242/158 R |
| 4,022,391 | 5/1977 | Stein et al. | 242/158 R X |
| 4,083,515 | 4/1978 | Dickerson | 242/158 R |
| 4,086,472 | 4/1978 | Sikora | 242/158 R X |
| 4,143,834 | 3/1979 | Hara et al. | 242/158 R |
| 4,150,801 | 4/1979 | Ikegami et al. | 242/158 R |
| 4,244,539 | 1/1981 | Taneda et al. | 242/158 R |

FOREIGN PATENT DOCUMENTS

| | | | |
|---|---|---|---|
| 17178 | 10/1980 | European Pat. Off. | 242/158 R |
| 22265 | 2/1983 | Japan | 242/158 R |
| 935084 | 8/1963 | United Kingdom | 242/158 R |

*Primary Examiner*—Stanley N. Gilreath

*Attorney, Agent, or Firm*—Hayes, Davis & Soloway

[57] ABSTRACT

During the various phases of fabrication of cables, tubes or similar products, it is necessary to load them onto spools. In certain cases, the winding must be particularly carefully done and have only close-packed windings, without overlap. The process and the device described bring a solution to the problem in the form of a feedback-control of the position of the winding guide. This control is realized such as to maintain the tightening-angle constant, that is the angle formed by the product at its loading-point referred to the preceeding turn, taking in consideration the irregularities of the real helix angle and the effect of the flanges of the loading spool.

4 Claims, 2 Drawing Sheets

$\gamma = \beta - \alpha$ $$D = \frac{\Delta L}{\Delta \Omega} \cdot 2 \qquad d = \frac{\Delta x}{\Delta \Omega} \cdot 2\pi$$

$$V = \frac{\Delta L}{\Delta t} \qquad \omega = \frac{d\Omega}{dt}$$

PROCESS FOR AUTOMATIC FEEDBACK CONTROLLED CABLE WINDING

This is a continuation of co-pending application Ser. No. 896,309 filed on Aug. 12, 1986, now abandoned, which is a continuation of Ser. No. 541,558 filed on Oct. 13, 1983, now abandoned.

The present invention relates to a process for automatic feedback-controlled winding of a cable or the like.

BACKGROUND OF THE INVENTION

When manufacturing power, telephone, electrical and various other cables or products produced continuously, it is necessary and often desirable to store them by winding them on spools. The spools normally consist of a cylindrical center portion and two side surfaces, hereinafter called flanges, lying substantially perpendicular to the axis of the cylinder. During the winding operation, the spool is normally rotated in one direction and the cable is guided so as to result in a very orderly winding of the cable wherein adjacent turns are as close to one another as possible. The spool is normally turned by a motorize drive while the guiding device of the product can either be controlled manually or by an automatic guide mechanism.

Automatic winding of cables and the like are divided into two groups, the first group being a fixed spool with a moving guide and the second group being a moving spool with a fixed guide. In both of these cases, the relative rotational movement of the winding device is controlled by a variable speed motor to ensure that the spool rotation coupled with the relative displacement of the guide result in a properly wound cable. The guide normally has end of travel stops which serve to reverse the direction of the guide when the cable reaches either end flange.

When manually guiding the cable, the operator tries to obtain as precise a winding as possible without any spacing between the adjacent windings and without any overlap. In the past, this is achieved by manually correcting the position of the guide and/or pitch so that a small overlapping force against the adjacent cable of the preceding turn occurs to insure a tight winding.

The present inventors have observed that the following parameters tend to make automatic winding of cables very difficult. The first being that the spool is not geometrically perfect because the cylinder body may not be exactly centered on the axis of rotation and the flanges may be only imperfectly perpendicular to the axis. Secondly, the start of the cable winding and the change of a winding layer at the flange constitute winding discontinuities which propagate from one turn to the next and often from one layer to the next. Consequently, the pitch of the winding is not always constant and a perfectly wound cable does not have an exact helical form. Because of these variables, winding by advance programming doesn't permit, in many cases, a perfectly wound roll as desired by the cable manufacturer.

The object of the present invention is to control the relative position between the guide and the spool to result in a substantially perfectly wound spool.

BRIEF DESCRIPTION OF THE DRAWINGS

For a fuller understanding of the nature of the objects in the present invention, reference should be had to the following description in connection with the accompanying drawings wherein.

DETAILED DESCRIPTION OF THE DRAWINGS

Figure 1:
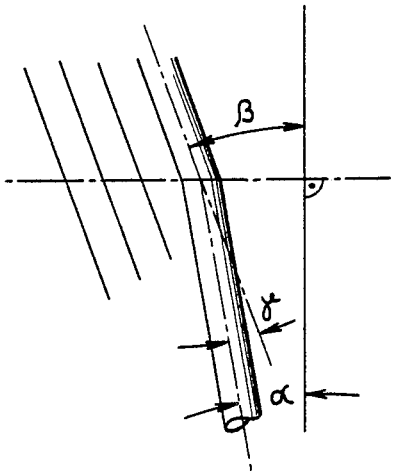
FIG. 1 is a partial view schematically representing a cable in the process of being wound.

Turning now to FIG. 1, $\alpha$ is designated as the loading angle, that is, the angle formed by a rectilinear part of the cable situated just before the point tangent to the spool with a plane perpendicular to the axis of rotation. The angle $\beta$ is the helix angle formed by a tangent of the already wound cable with a plane perpendicular to the axis of rotation of the spool. $\gamma$ is the tightening angle which is formed by a rectilinear part of the cable situated just before the point tangent to the spool and the tangent point of the preceding turn of the cable. If the tightening angle is either too large or too small, the newly formed turn will either overlap the preceding turn or will separate from the preceding turn, respectively.

Since the helix angle $\beta$ is not constant, as discussed above, it follows that the load angle $\alpha$ must be continually adjusted in order to obtain a perfectly wound spool. However, difficulties consist in defining a reference value for these measurements. The present inventors have found that if the load angle $\alpha$ and the helix angle $\beta$ are measured, then the tightening angle $\gamma$ may be determined by the formula of $\gamma=\beta-\alpha$.

In FIG. 1, it is to be noted that the helix angle $\alpha$ is somewhat exaggerated for clarity in the drawings. Experimentation has shown that the tightening angle $\gamma$ is normally larger than the helix angle $\beta$. This being true, it follows that the load angle $\alpha(=\beta-\gamma)$ is in reality a negative value, and this means that the cable is in fact positioned to the left of the last turn on the spool.

Figure 2:
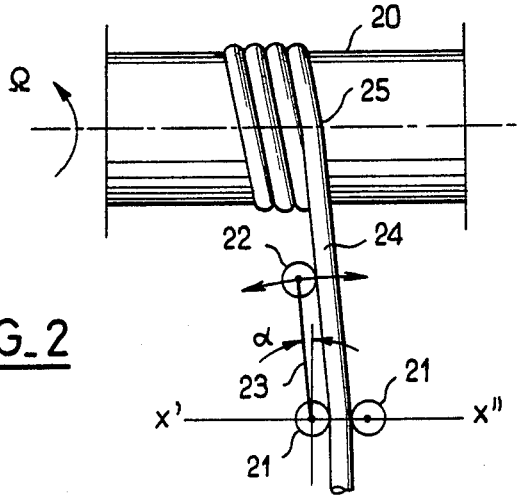
FIG. 2 schematically shows a top view of a winding apparatus in accordance with the present invention.

Turning now to FIG. 2, it can be seen that the device of the present invention has a spool 20 rotating about a longitudinal rotational axis and this rotation is achieved by a motorized drive (not shown). The motorized drive is equipped with a first measuring device, such as a potentiometer or optical encoder, to furnish an electrical signal indicating the angular position $\Omega$ of the spool. The measuring device may also furnish information concerning shaft speed and this signal could be in pulses in the case of an incremental measuring device.

A guide 21, 22, 23, consisting of two cylindrical rollers 21 which serve to guide the cable during winding, is also shown in FIG. 2. This guide moves along the X' X'' axis which is parallel to the rotational axis of the spool. A motorized displacement device, which is well known in the art such as a lead screw or chain drive, provides axial displacement of the guide. This motorized displacement device is provided with a second measuring device (a potentiometer or an optical encoder) which furnishes an analog or digital signal corresponding to the relative displacement of the guide along the X' X'' axis in absolute or incremental values.

A third measuring device integral with an arm 23, carrying an oscillating roller 22, provides information for determining the load angle $\alpha$ which is formed between the cable 24 and a plane perpendicular to the axis of rotation of the spool 20. The arm 23 supporting the roller 22 is pivoted at the center of one of the two guide rollers 21. Force is applied to arm 23 by either a pneumatic cylinder or a spring (not shown) to insure that it is kept in constant contact with the cable so as to provide an accurate load angle reading.

In the case of a pneumatic cylinder, the roller 22 could automatically be moved to the far left during the start of the winding operation of the cable and once cable 24 has been attached to spool 20, roller 22 can then be moved to the right to engage the cable 24 and provide a load angle measurement. The measuring device defining the load angle $\alpha$ may be a coaxial potentiometer at the point of oscillation of arm 23 or it could be an inductive, capacitive or binary encoder. It also could be linear, i.e. fixed to a spring or a pneumatic return piston.

The roller 22 may also be furnished with a rotational measuring device (an incremental device for example) for determining the linear speed and wound length of the cable. This measurement also could be provided independently from the roller 22, i.e. it could be furnished by the production machine. Since such measuring devices are well known in the art, further detailed description relating thereto is not provided.

If the winding configuration consists of a fixed guide with an axially movable spool, the longitudinal measuring device of the guide 21 along the X' X" axis simply replaced by an equivalent measuring device which measures the axial position of the spool. The other measuring devices will perform as previously indicated the only difference being that the reference point may change. The moving spool configuration, although more costly, presents the advantage of a fixed position and direction of the cable at its entry into the guide which is normally along the axis of the production machine.

The system described to this point consists of a motorized winding spool having a measuring device for determining its angular position $\Omega$, a guide which guides the cable being wound, a feedback control mechanism controlling the position of the spool relative to the guide; an oscillating roller measuring the load angle $\alpha$ formed by the cable; and a rotation measuring device furnishing information about the cable being wound.

It is to be noted that in order to reduce the risk of crushing the cable during the winding operation, the rollers 21 have enough play to compensate for variations in the wire diameter. Secondly, since the cable may not be flexible, the exact load angle $\alpha$ may not be identical to the measured value because the cable has a certain curvature in the region of rollers 21.

The present inventors have found that optimum tightening angle (determined experimentally) is a function of the cable being wound. This angle is dependent upon the diameter, rigidity, coefficient of friction, etc. of the cable. In practice, we have found that this angle is between the two extremes, i.e. the value resulting in overlap of the cable and the value resulting in non-juxtaposed winding of the cables. In most cases, an approximation may be used without introducing significant error.

In the case of a fixed guide and moving spool, one of the guide rollers 21 may be traversely mobile and its position or its force reading being feedback controlled. This could occur by having feelers situated upstream from the guide rollers and they would control the position of the mobile roller 21 as a function of the feeler position. Alternately, a force measuring device connected to the fixed position roller could pull in or push out the mobile roller depending upon the measured force. Thirdly, the rotational measuring device of the fixed roller could pull in the mobile roller when the rotational movement of the fixed rollers stop. Fourthly, without a feedback control, it would be sufficient to furnish each of the two rollers with a rotation measuring device. As the cable pushes against one or the other of the rollers, one or both could turn. This information could then be used to adjust the position of a mobile roller.

Figure 3:
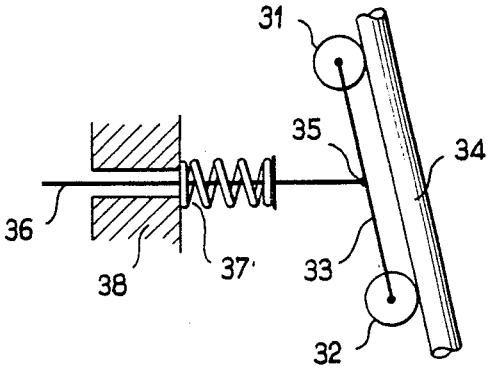
FIG. 3 shows an alternate means for measuring the load angle of the cable in accordance with the present invention.

In the case of measuring a particularly rigid and/or large diameter cable, the error in measuring the load angle may not be negligeable. This is true even if the oscillating lever is relatively long because the cable is unable to quickly change its orientation at the exit of guide rollers 21. In this instance, the oscillating arm shown in FIG. 3 appears to work best. FIG. 3 shows two rollers 31, 32 mounted on an oscillating arm 33 which is forced against the cable 34. The angular measuring device (not shown) for measuring the load angle is then mounted at the pivot point 35 of the arm 33 and it uses sliding support 36 as a reference point. The device is equipped with a spring 37 supported by a fixed guide 38 to maintain the rollers 31, 32 in contact with the cable 34. The spring 37 could be replaced with a pneumatic cylinder or other conventional means which assure longitudinal displacement of the guide parallel to the rotational axis of the spool. However, it is to be remembered that the guide device must be applied to a portion of the cable considered reasonably rectilinear, i.e. somewhere between the guide rollers 21 and the cable tangent point with the spool 25. The spacing distance between the spool and guide can be increased if necesssary.

Figure 4:
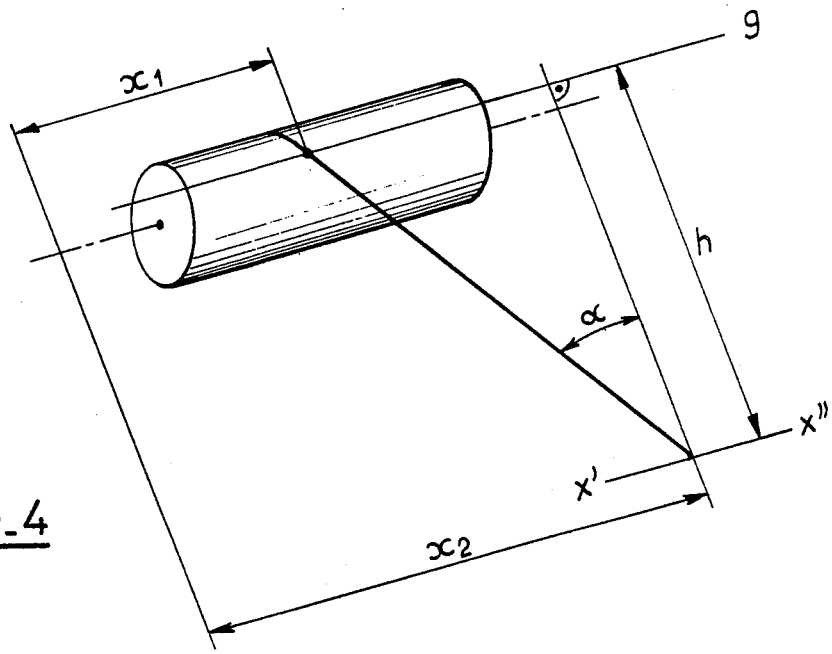
FIG. 4 shows the geometric angles involved in controlling the winding of the cable.

Having demonstrated how to measure the load angle $\alpha$, we now direct our attention to measuring the helix angle $\beta$ of the preceeding turn, particularly at the tangent point of the cable with the spool being wound. FIG. 4 shows a segment of the cable between the guide, having its abscissa $x_2$ on the axis of X' X", and its contact point at abscissa $x_1$ at a tangent point on the surface of the cylinder. H is the distance between the axis X' X" and the contact point of the cable with the spool. The load angle $\alpha$ is the angle formed by a rectilinear part of the cable and a plane perpendicular to the axis of rotation of the spool.

In examining FIG. 4, we note that elementary geometry indicates that a simple trigonometric relationship can be used to determine the unknown variables. The relationship is $$x_1 = x_2 - h \cdot \tan \alpha$$

The relative absicissa $x_2$ may be measured by the translational measuring device and the position of the tangent point may be determined by calculating it at any instant by use of a microprocessor. These values are stored in memory. By correlating the stored values with the rotational position $\Omega$ of the spool, the position of the preceeding turn may be determined.

As previously stated, the load angle of the cable being wound is generally negative. Thus, contrary to the representation shown in FIG. 4, $x_1$ is less than $x_2$. Note also that the distance h varies as the diameter of the spool increases because of the cable being wound on the spool increases the spool's diameter. The variation is relatively small and generally no correction is required, although a corrective trigonometric calculation could be done by the microprocessor if necessary to adjust the value of h.

Moreover, the microprocessor can furnish, by simple calculation, the value of the helix angle at any desired point according to the relation of:

$$\tan\beta = \frac{dx}{dl} = \frac{dx}{d\Omega} \times \frac{d\Omega}{dl} = \frac{\Delta x}{\Delta\Omega} \times \frac{\Delta\Omega}{\Delta l}$$

if the differentials are replaced with the differences. $\Delta x$ is the difference between two successive values $x_n$ and $x_{n+1}$ calculated for the abscissa of the tangent point corresponding to two successive values $\Omega_n$ and $\Omega_{n+1}$ of the angular position of the spool stored in memory. $\Delta l$ corresponds to the length of the cable being wound on the spool during that same time interval. Thus, $$\Delta l = l_{n+1} - l_n.$$

In the case of spools of known diameter, the microprocessor itself can calculate the length of cable being wound without the need of an additional measuring device. For the first layer, we have $l_1 = \pi \cdot n_1 \cdot D$ where n is a number of turns determined from $\Omega$ and D is the diameter of the spool. For the second layer, $l_2 = \pi \cdot n_2 \cdot (D+d)$ where d is the diameter of the cable and this can be inputed or determined by the microprocessor. The value $\Delta\Omega/\Delta l$ is obtained in a similar fashion because the microprocessor memorizes the number of layers wound by noting a change in direction of the guide. Similar trigonometic calculations will permit calculation of the relative position of the spool and guide, determined from the reference value, in order to determine the correct load angle $\alpha$ which, as described above, has a relationship of $\alpha = \beta - \gamma$. $\gamma_o$ is the experimentally determined tightening angle which is constant for a given cable. This value can be inputed as a set point and it also could be determined automatically by a processor from given values in memory based upon the type and diameter of the cable.

Control of the winding apparatus could just as easily take $\alpha$ as the set point and the measured value would be given by the load angle measuring device. A quick look at the algorithms show that the result is identical and the bases of the calculation is in fact the same. However, the Applicant has found that the control of the position $x_2$ along the X' X'' axis is preferred.

Another way of obtaining the helix angle $\beta$ is to determine it based upon an analysis of a TV camera mounted perpendicular to the axis of rotation of the spool which observes the winding operation.

This system as described up to this point assures correct winding of the cable of the preceeding turn being subsequent winding layers. There remains, however, the examination of correct winding at the start of the winding and upon a change in direction of the winding when it abuts against the flanges.

The attachment of the beginning of the cable is performed manually and the laying of the first winding is considered an operation which is not feedback controlled but rather an open looped program. The first part of the cable being simply wound against the flange. The winding thereafter will be effected according to the pitch fixed by the known diameter of the cable or by a manual displacement command. The engagement of the feedback controller will occur either automatically or by the operator engaging it. Memorization of the parameters x, $\alpha$ and $\Omega$ begin at the start of rotation and automatic control could intervene immediately since the position of the helical anomally caused by the start of the first turn is known.

As the cable arrives against the flange, this represents an anomally which the systems must interpret. The last free turn of the winding being layed in a cylindrical helix, it would seem that the controller would continue to displace the guide or the spool as a function of the last turn. However, with the cable arriving at the flange, the effective pitch of the cable will essencially be zero (within the limits of irregularity of the flange). The measured effective loading angle $\alpha$ will therefore be progressively modified. A comparasion of the successive values stored in memory, corresponding to the preceeding turn, will enable reversing of the helix pitch after having passed a predetermined threshold. In order to avoid an overlap, this reversing will be done for example after a little less than one turn thus starting the first complete turn of the new layer by automatic programming. It is to be noted that the diameter of the cable is known by the microprocessor at this moment either because a measuring device determines this from the separation of the guides 21 or because the microprocessor has calculated it from the mean difference of successive values of winding on the spool.

Figure 5:
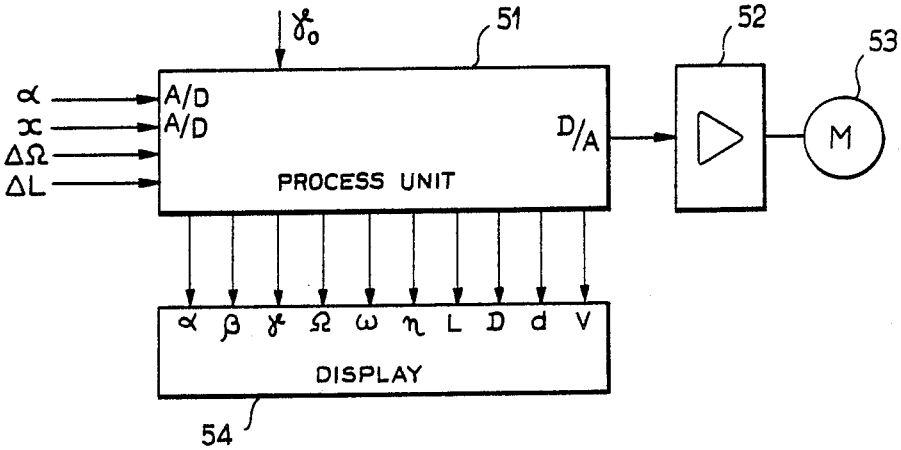
FIG. 5 shows schematically a simplified flow diagram of the processing system used to control the winding of the cable.

Turning now to FIG. 5, the device consists of a command unit 51 having the necessary interfaces to receive signals coming from the measuring devices and it may include an analog/digitial converter for reading the potentiometers corresponding to the angles and abscissa readings. The command unit also permits the introduction and correction of the determined tightening angle, and a microprocessor or arithmetic unit for treatment of the inputed and stored data, according to a software program. An analog/digital converter furnishes the set point value of the abscissa x for the relative displacement of the guide or spool and a feedback control power amplifier 52 controls motor 53 for assuring correct displacement of the guide or spool. If necessary, the processor can be provided with a display device 54 which will provide easy viewing of the current parameters.

Experience has shown that if the translational movement of the guide is not very critical, the feedback control power amplifier could, in order to reduce cost, be replaced by two comparators having a reference value obtained from the calculator and a real position measured by the measuring device. The output signals from these comparators will serve as signals to two relays for determining the rotational direction of a simple three phase motor and it will be activated in small successive displacements. This solution is considerably less costly than a regulator and a DC motor, especially if one is converting an already existing installation.

Wherefore having described my invention I claim:

1. A process for automatically winding an elongate object on a motorized spool (20), about an axis of rotation having a guiding means (21, 22, 23) and a controlled feedback means (52) for adjusting movement of one of said spool and guide means, comprising the steps of measuring corresponding angular position $\Omega$ of the motorized spool, axial displacement of one of said spool and said guiding means and a load angle $\alpha$, where the load angle $\alpha$ is the angle formed by a rectilinear part of the elongate object with a plane perpendicular to said axis of rotation of the spool, transmitting the measured data to an electronic recording, memorizing and calculating means, determining a desired helix angle $\beta$, where the helix angle $\beta$ is the angle formed by a tangent point at any point along the already wound elongate object and a plane perpendicular to the axis of rotation of the spool, calculating a tightening angle $\gamma$, where the tightening angle $\gamma$ is the angle formed by the rectilinear part of the elongate object and a tangent point of the preceding turn, by the difference between the helix angle $\beta$ of the preceding turn and the load angle $\alpha$, and controlling said feedback means to adjust the relative position of said one of said spool and said guide means to maintain said tightening angle $\gamma$ substantially constant and equal to a predetermined tightening angle $\gamma_o$.

2. A process according to the claim 1, further comprising the step of calculating linear speed of the elongate object from the data transmitted relating to the angular position $\Omega$ of said motorized spool and adding the thickness of any completed layer to the diameter of the spool.

3. Process according to claim 1, further comprising the step of using an electronic camera to determining the helix angle $\beta$ of the elongate object.

4. Process according to the claim 2, further comprising the step of calculating arrival at the last turn of a layer of said elongate object against a flange of said motorized spool indirectly during the laying of the last turn of a layer and comparing these calculated values with values which were successively memorized according to the preceding turn and using data resulting from this calculation for controlling the reverse direction of winding, the arrival at said last turn being defined by an annulation of the effective pitch of the turns.

* * * * *